US010100578B2

(12) United States Patent
Lyon

(10) Patent No.: US 10,100,578 B2
(45) Date of Patent: Oct. 16, 2018

(54) PRESSURE CONTROL CHECK VALVE FOR A DOWN-THE-HOLE DRILL HAMMER

(71) Applicant: Center Rock Inc., Berlin, PA (US)

(72) Inventor: Leland H. Lyon, Roanoke, VA (US)

(73) Assignee: Center Rock, Inc., Berlin, PA (US)

( * ) Notice: Subject to any disclaimer, the term of this patent is extended or adjusted under 35 U.S.C. 154(b) by 785 days.

(21) Appl. No.: 14/295,926

(22) Filed: Jun. 4, 2014

(65) Prior Publication Data

US 2014/0360783 A1 Dec. 11, 2014

Related U.S. Application Data

(60) Provisional application No. 61/833,305, filed on Jun. 10, 2013.

(51) Int. Cl.
*E21B 4/14* (2006.01)

(52) U.S. Cl.
CPC ..... *E21B 4/14* (2013.01)

(58) Field of Classification Search
CPC . E21B 4/14; E21B 1/00; E21B 34/101; F16K 15/063; F16K 17/196; F16K 17/044; F16K 17/26; F16K 17/30
USPC ..... 166/324, 325; 175/296, 297
See application file for complete search history.

(56) References Cited

U.S. PATENT DOCUMENTS 2,758,817 A * 8/1956 Bassinger ..... E21B 4/14 173/121
2,943,603 A * 7/1960 Bassinger ..... E21B 4/14 173/1
3,112,763 A * 12/1963 Tennis ..... F16K 17/18 137/493.5
3,136,375 A * 6/1964 Lear ..... E21B 4/14 173/137
3,319,723 A * 5/1967 Kramer ..... B25B 21/02 173/220
3,387,671 A * 6/1968 Collier ..... E21B 4/14 173/73
4,100,976 A * 7/1978 Stone ..... E21B 4/14 173/133
4,120,097 A * 10/1978 Jeter ..... E21B 47/022 175/45
4,133,393 A * 1/1979 Richards ..... E21B 4/14 173/17
4,333,537 A * 6/1982 Harris ..... E21B 4/14 173/17
4,530,408 A * 7/1985 Toutant ..... E21B 4/14 173/136
4,703,774 A * 11/1987 Seehausen ..... E21B 33/0355 137/614

(Continued)

FOREIGN PATENT DOCUMENTS

GB 1498487 A * 1/1978 ..... E21B 4/14

*Primary Examiner* — Jennifer H Gay
(74) *Attorney, Agent, or Firm* — Kim Winston LLP

(57) ABSTRACT

A down-the-hole drill hammer for optimizing air consumption. The down-the-hole drill hammer includes a housing, a backhead connected to the housing, and a pressure control check valve assembly mounted within the housing. The pressure control check valve assembly includes a first check valve and a second check valve. The first check valve controls a flow of working fluid through the backhead. The second check valve is mounted to the first check valve and controls a flow of working fluid through the first check valve.

26 Claims, 11 Drawing Sheets

(56) References Cited

U.S. PATENT DOCUMENTS 4,819,739 A * 4/1989 Fuller ..... E21B 4/14 173/17
4,878,550 A * 11/1989 Chuang ..... E21B 4/14 173/207
4,923,018 A * 5/1990 Meek ..... E21B 21/16 173/135
4,936,397 A * 6/1990 McDonald ..... E21B 4/02 175/107
5,107,679 A * 4/1992 Bartlett ..... F16K 17/30 137/498
5,224,465 A * 7/1993 Milliman ..... F41B 11/723 124/69
5,277,260 A * 1/1994 Ranck ..... E21B 4/14 173/128
5,301,761 A * 4/1994 Fu ..... E21B 4/14 166/319
5,318,140 A * 6/1994 Ekwall ..... E21B 4/14 173/78
5,320,181 A * 6/1994 Lantier, Sr. ..... E21B 21/10 166/325
5,676,172 A * 10/1997 Mukumoto ..... F16K 17/044 137/488
6,050,544 A * 4/2000 Meronek ..... E21B 33/0355 251/149.6
6,164,393 A * 12/2000 Bakke ..... E21B 31/113 173/177
7,509,969 B2 * 3/2009 Huang ..... F16K 15/026 137/226
7,568,497 B1 * 8/2009 Langenfeld ..... F16K 15/025 137/493.3
8,539,976 B1 * 9/2013 Rodgers, Jr. ..... F16K 15/066 137/512
2004/0045716 A1 * 3/2004 Bakke ..... E21B 31/113 166/301
2004/0140131 A1 * 7/2004 Susman ..... E21B 4/14 175/296
2006/0112993 A1 * 6/2006 Dong ..... F16K 17/26 137/493.6
2008/0099218 A1 * 5/2008 Simmons ..... E21B 21/10 173/13
2008/0156540 A1 * 7/2008 Beccu ..... E21B 4/14 175/296
2009/0294180 A1 * 12/2009 Swadi ..... E21B 17/07 175/293
2010/0059284 A1 * 3/2010 Lyon ..... E21B 4/14 175/296
2010/0187016 A1 * 7/2010 Marshall ..... E21B 4/14 175/293
2010/0300763 A1 * 12/2010 Lorger ..... E21B 4/14 175/296
2011/0192650 A1 * 8/2011 Swadi ..... C22C 1/05 175/296
2011/0297447 A1 * 12/2011 Lyon ..... E21B 4/14 175/296
2012/0006598 A1 * 1/2012 Lyon ..... E21B 4/14 175/296
2012/0118648 A1 * 5/2012 Lorger ..... E21B 4/14 175/296
2014/0360783 A1 * 12/2014 Lyon ..... E21B 4/14 175/57

* cited by examiner

PRESSURE CONTROL CHECK VALVE FOR A DOWN-THE-HOLE DRILL HAMMER

CROSS-REFERENCE TO RELATED APPLICATIONS

This application claims the benefit of U.S. Provisional Application No. 61/833,305, filed Jun. 10, 2013, the entire disclosure of which is incorporated by reference herein in its entirety.

BACKGROUND OF THE INVENTION

The present invention relates generally to down-the-hole drill (DHD) hammers. In particular, the present invention relates to a pressure control check valve for a down-the-hole drill hammer.

Typical DHD hammers have a check valve and a fixed flow area within the DHD hammer. As such, the DHD hammer operates with working air volumes flowing through the fixed flow area within DHD hammer. Such fixed flow areas provide for adequate operation of the DHD hammer under normal dry conditions. Moreover, the filling and draining of working volumes within the DHD develop a pressure-flow characteristic that mimics a fixed orifice or port. However, DHD hammers often operate under "wet" conditions, e.g., when the drill hole is filled with water and the DHD hammer is submerged. Under such wet operating conditions, the wet conditions necessarily require the DHD hammer to operate under higher pressures to account for increases in outside pressures resulting from the wet operating conditions. To accommodate such wet operating conditions, the compressor used to supply feed air to the DHD hammer must supply higher working air pressures. However, typical compressors have a maximum operating pressure and when such maximum operating pressure is exceeded, the compressor must be adjusted to reduce its output air flow to compensate for the increases in outside pressures in order to most efficiently operate the DHD hammer. Without such adjustments to the compressor, conventional DHD hammers will not operate in its most efficient manner.

In other words, in down hole drill applications, especially deep holes where the presence of influx water is unknown, it would be desirable to perfectly match air consumption and pressure to the down hole drill to the capabilities of the power source. This ideal pairing would result in maximum down hole drilling performance. However, because the down hole drill must be setup for worst-case wet hole conditions operators do not have the ability to maximize performance for dry hole conditions which is normally drilled before wet zones are encountered. The problem is that when a drill hole becomes wet a much higher circulating pressure is needed and without adjustments to the down hole drill to reduce operating pressure, the pressure capacity of air compressors is exceeded and air flow must be reduced.

As such, a need exists for a DHD hammer than can address the foregoing limitations of conventional DHD hammers, e.g., a DHD hammer that adjusts its air flow depending on down hole pressure differentials so that as pressure increases within the hole, more air will be bypassed to manage compressor pressure. Such a need is satisfied by the DHD hammer of the present invention having a pressure control check valve.

BRIEF SUMMARY OF THE INVENTION

In accordance with a preferred embodiment, the present invention provides a down-the-hole drill hammer that includes a housing, a backhead connected to the housing, and a check valve mounted within the housing. The check valve includes a relief valve for controlling a flow of working fluid through the check valve.

In accordance with another preferred embodiment, the present invention provides a pressure control check valve assembly for a down-the-hole drill hammer. The pressure control check valve assembly includes a first check valve and a second check valve. The first check valve includes a valve housing, a passageway extending through the valve housing, and a first biasing member biasing the first check valve. The second check valve is mounted to the first check valve and controls a flow of working fluid through the passageway. The second check valve includes a second biasing member biasing the second check valve.

In accordance with yet another preferred embodiment, the present invention provides a down-the-hole drill hammer that includes a housing, a backhead connected to the housing, a drive chamber within the housing, a first flow passageway, and a second flow passageway. The backhead includes a supply inlet. The first flow passageway is in fluid communication between the supply inlet and the drive chamber and is formed at a first differential pressure across the hammer. The second flow passageway is in fluid communication between the supply inlet and the drive chamber and is formed at a second differential pressure across the hammer that is greater than the first differential pressure across the hammer.

In accordance with another preferred embodiment, the present invention provides a method of optimizing air consumption within a down-the-hole drill hammer. The method comprises providing a down-the-hole drill hammer having a pressure control check valve assembly that includes a first flow passageway and a second flow passageway, and feeding supply air to the hammer at a first pressure through the first flow passageway while the second flow passageway is closed. The method also includes opening the second flow passageway when a pressure differential between a hammer inlet pressure and a hammer outlet pressure exceeds a predetermined value.

BRIEF DESCRIPTION OF THE SEVERAL VIEWS OF THE DRAWINGS

The foregoing summary, as well as the following detailed description of the preferred embodiments of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown.

In the drawings.

DETAILED DESCRIPTION OF THE INVENTION

Figure 1:
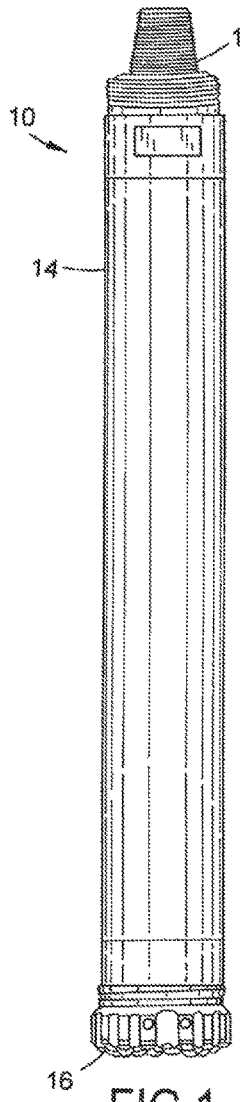
FIG. 1 is a side elevation perspective view of a down-the-hole drill hammer in accordance with a preferred embodiment of the present invention.

Reference will now be made in detail to the preferred embodiments of the invention illustrated in the accompanying drawings. Wherever possible, the same or like reference numbers will be used throughout the drawings to refer to the same or like features. It should be noted that the drawings are in simplified form and are not drawn to precise scale. In reference to the disclosure herein, for purposes of convenience and clarity only, directional terms such as top, bottom, above, below and diagonal, are used with respect to the accompanying drawings. Such directional terms used in conjunction with the following description of the drawings should not be construed to limit the scope of the invention in any manner not explicitly set forth. Additionally, the term "a," as used in the specification, means "at least one." The terminology includes the words above specifically mentioned, derivatives thereof, and words of similar import.

Referring to FIGS. 1-14, in a preferred embodiment, the present invention provides a DHD hammer 10, as shown. The DHD hammer 10 includes a backhead 12, a casing or housing 14, and a drill bit 16. The backhead 12 is connected to the housing and includes a supply inlet 18 that receives working fluid from a drill string (not shown) attached to the backhead. The feed of supply air (i.e., working fluid) passes through the supply inlet into the internals of the DHD hammer. But before passing to the internals of the DHD hammer, the flow of working fluid first encounters a pressure control check valve assembly 20, as further described below.

Figure 2:
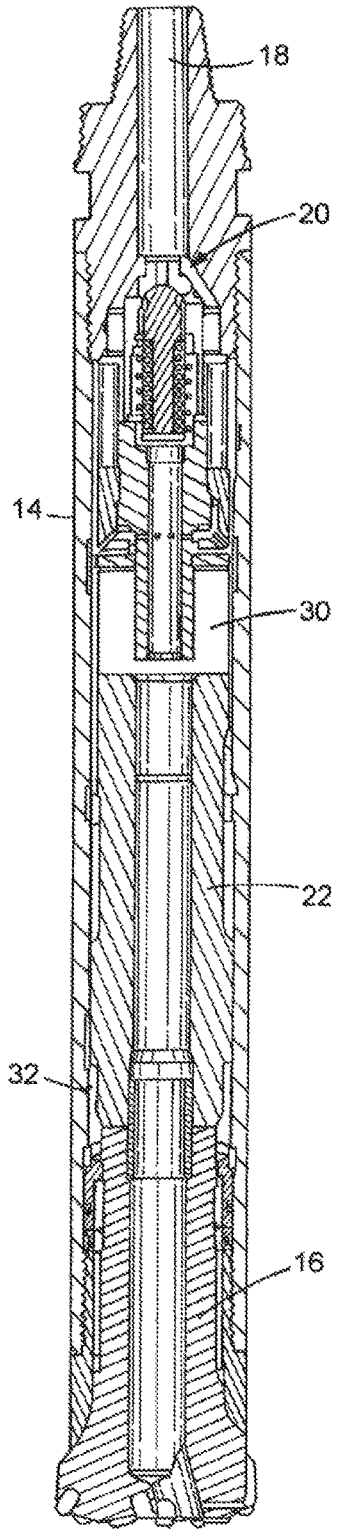
FIG. 2 is a cross-sectional side elevation view of the down-the-hole drill hammer of FIG. 1.
Figure 3:
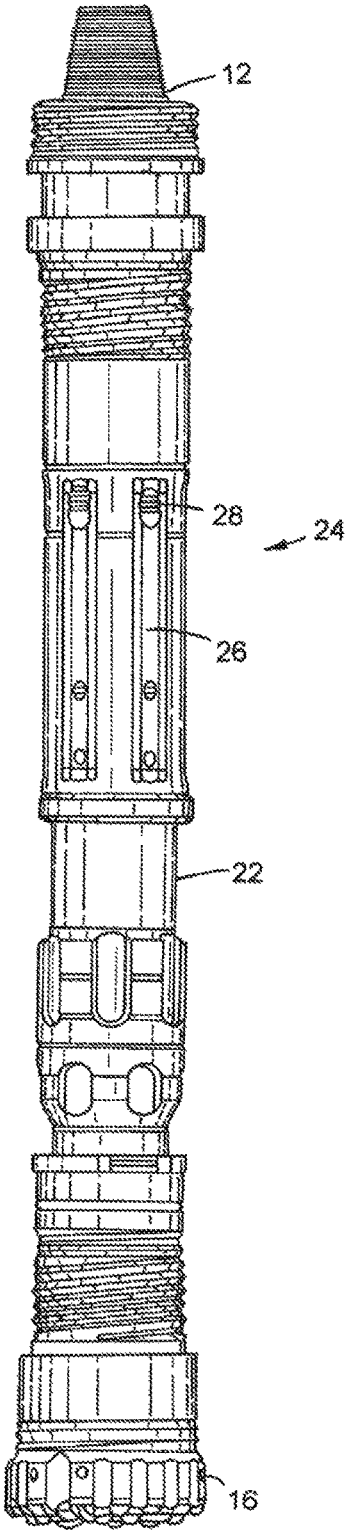
FIG. 3 is a side elevation view of the down-the-hole drill hammer of FIG. 1 without a housing.

Referring to FIGS. 2 and 3, the DHD hammer 10 also includes a piston 22 that reciprocatively and percussively moves within the casing 14 in a well known manner for impacting the drill bit 16. The percussive movement of the piston 22 is powered by a power source (e.g., an air compressor) that supplies working fluid volumes to the DHD hammer 10 via the drill string and which flows through a porting system 24 to drive percussive action. The porting system 24 includes apertures and passageways formed by various components of the DHD hammer to allow for the flow of supply air (i.e., working fluid) to enter the DHD hammer's drive and return chambers, as commonly known in the art. Such components of the porting system 24 include apertures 26 and passages 28, and spaces formed between the housing inner wall surface and various internal components of the DHD hammer. The porting system 24 allows supply air to feed into the DHD hammer's respective drive chamber 30 and return chamber 32, which collectively operate to impart and drive percussive movement of the piston within the housing.

Figure 4:
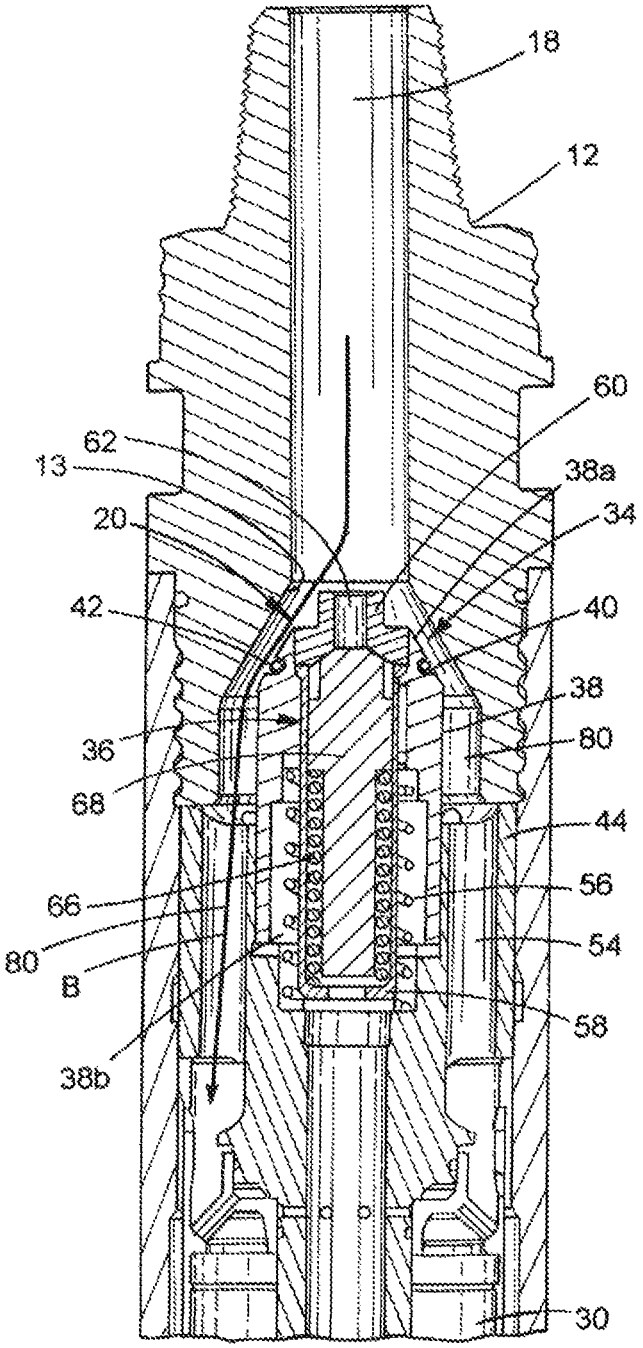
FIG. 4 is an enlarged partial cross-sectional elevation view of an upper end of the down-the-hole drill hammer of FIG. 1.
Figure 5:
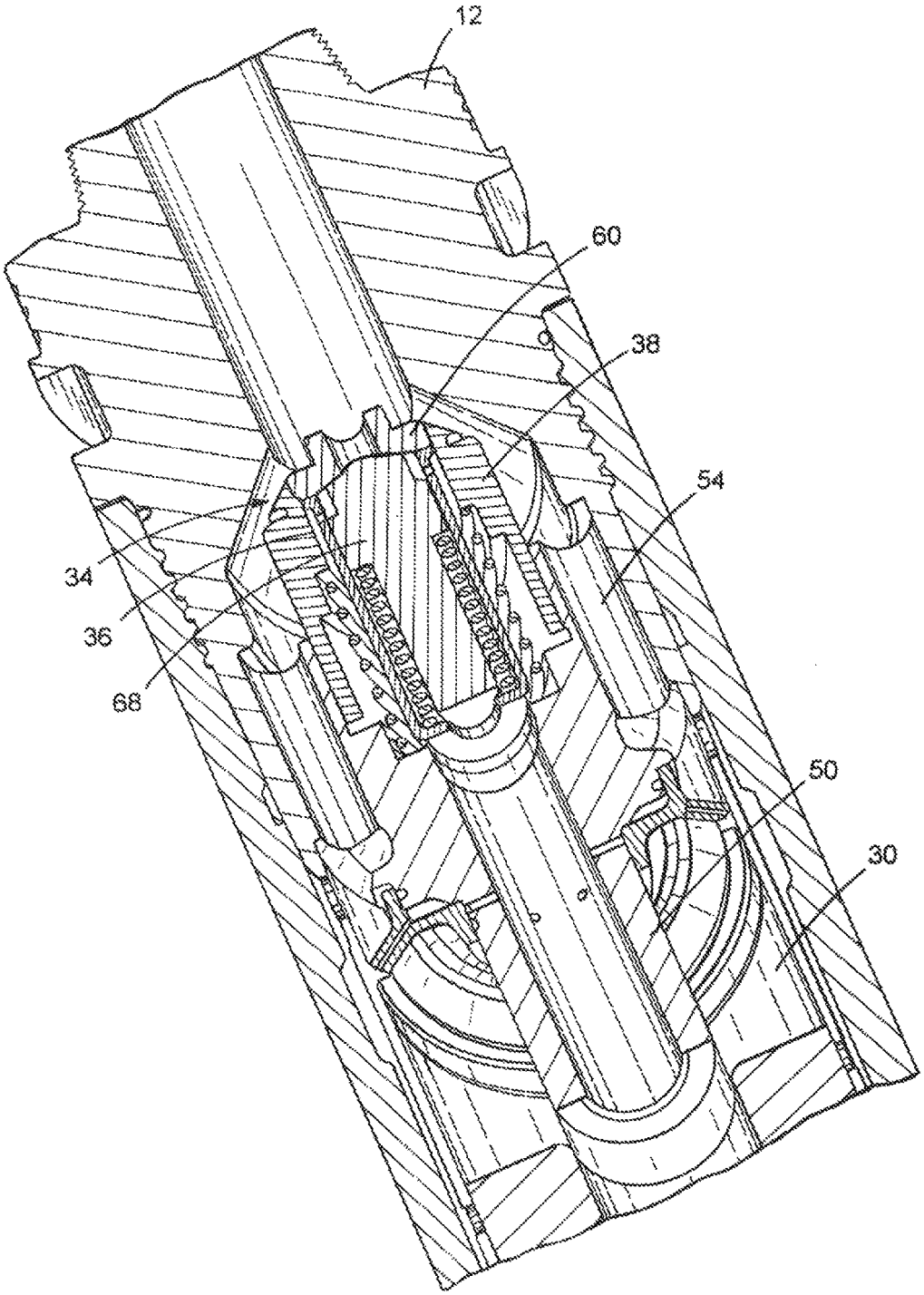
FIG. 5 is an enlarged partial cross-sectional perspective view of an upper end of the down-the-hole drill hammer of FIG. 1.

As best shown in FIG. 4, the DHD hammer 10 includes the pressure control check valve assembly 20 mounted within the housing. The pressure control check valve assembly 20 includes a first check valve 34 and a second check valve 36. The second check valve 36 is mounted to the first check valve 34 and preferably mounted within the first check valve. In operation, the pressure control check valve assembly controls the flow of working fluid through the backhead 12.

The first check valve 34 is configured to control the flow of working fluid through the backhead and includes a check valve housing 38 with a chamfered top end 38*a* and an open bottom end 38*b*. The check valve housing 38 has a passageway 64 (represented by arrow A, see FIG. 14) extending therethrough for allowing an additional flow passage of working fluid to the internals of the DHD hammer, as further described below. The chamfered top end 38*a* includes an annular groove 40 for receiving a seal 42, such as an elastomeric O-ring seal. The first check valve 34 is situated within an opening of a distributor 44 fixedly mounted within the housing 14 adjacent the backhead 12.

Figure 6:
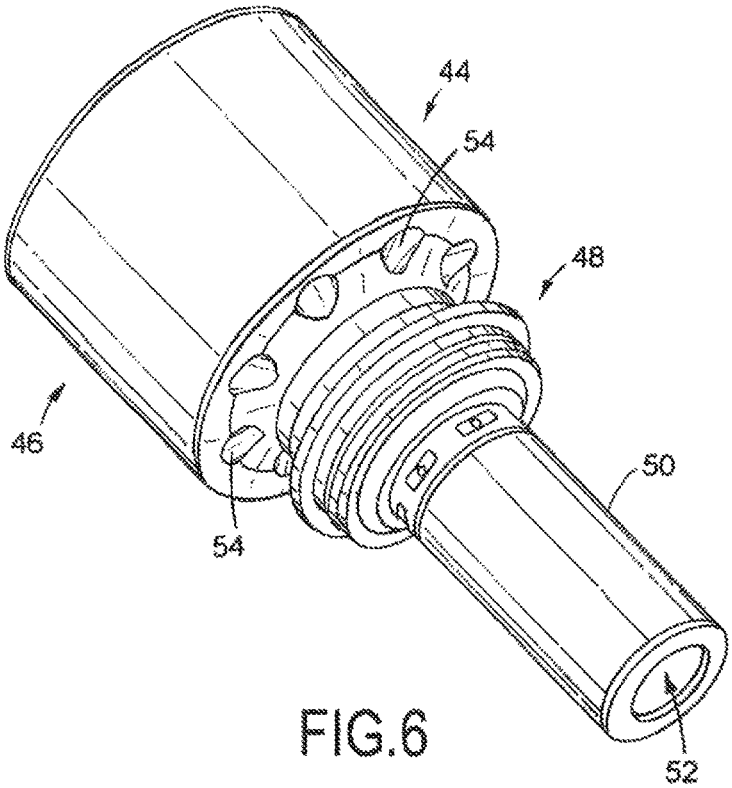
FIG. 6 is a perspective view of a distributor of the down-the-hole drill hammer of FIG. 1.
Figure 7:
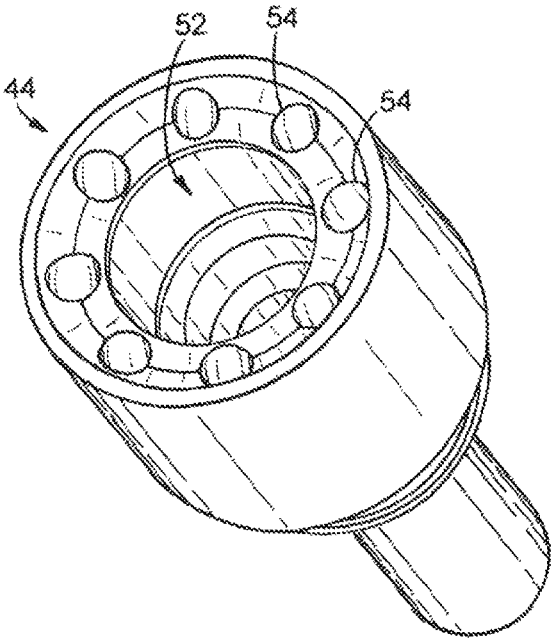
FIG. 7 is a top perspective view of the distributor of FIG. 6.
Figure 8:
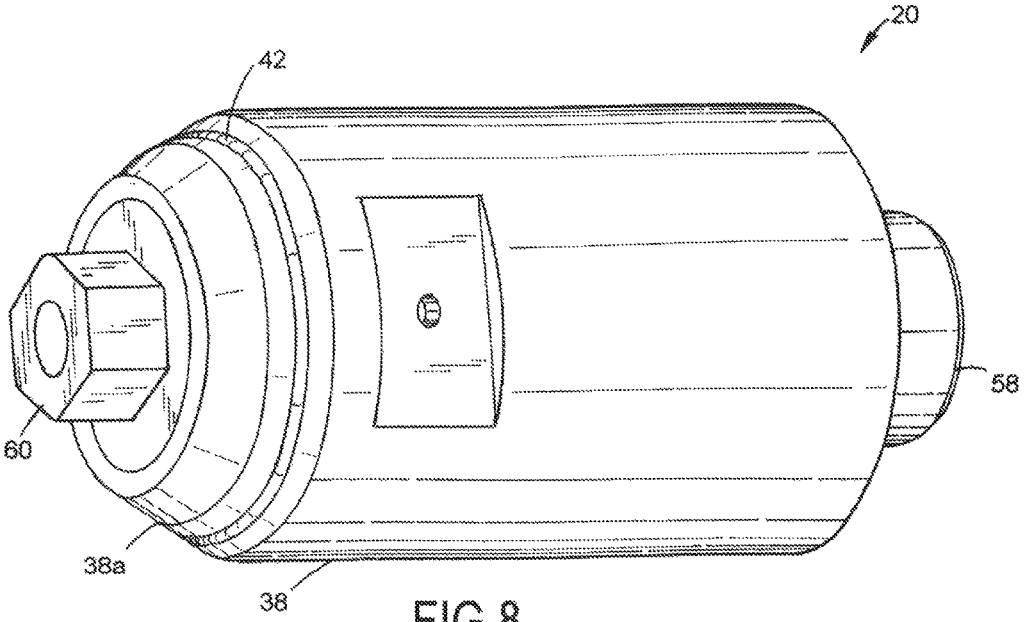
FIG. 8 is perspective view of a check valve of the down-the-hole drill hammer of FIG. 1.
Figure 9:
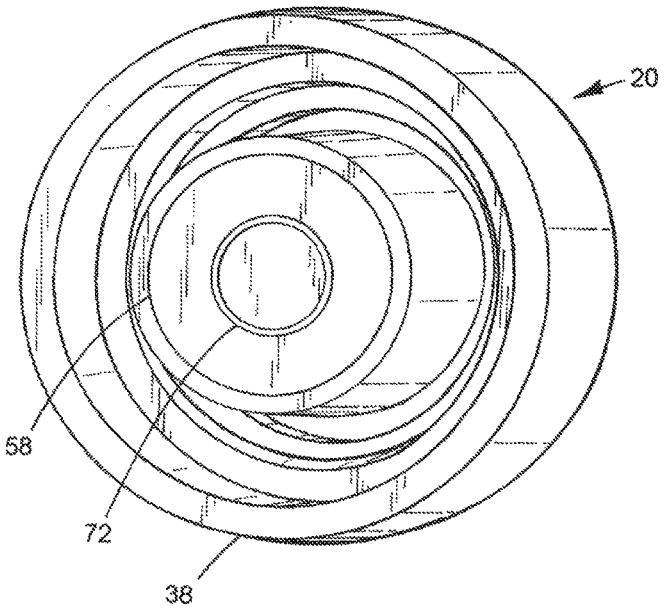
FIG. 9 is a bottom perspective view of the check valve of FIG. 8.

Referring to FIGS. 4, 6 and 7, the distributor 44 is configured as shown. The pressure control check valve assembly 20 is mounted within the distributor 44. The distributor 44 includes an upper body portion 46, a lower body portion 48, a stem 50 extending from the lower body portion, and a central through bore 52 extending through the upper body portion, the lower body portion and the stem. The upper body portion 46 of the distributor also includes a plurality of axial through holes 54 that are spaced from and circumscribe the central through bore 52. Preferably, the distributor includes eight axial through holes circumscribing the central through bore, but can alternatively include more or less than eight, such as at least one. The exhaust valve stem 50 is in fluid communication with the drive chamber 30 of the DHD hammer 10.

The first check valve 34 is configured to receive a first biasing member 56 which is preferably positioned internally of the check valve housing 38 for biasing the first check valve towards the backhead 12 and towards a closed position. One end of the first biasing member 56 biases against an internal surface of the distributor 44 while an opposite end of the first biasing member biases against the check valve housing 38. Preferably, the first biasing member 56 circumscribes a valve guide 58, as shown in FIG. 4 and further discussed below. The first biasing member 56 can be any biasing member suitable for the intended purposes described above, such as a compression spring, leaf spring, an elastomer, and the like. Preferably, the first biasing member is a compression spring.

Figure 10:
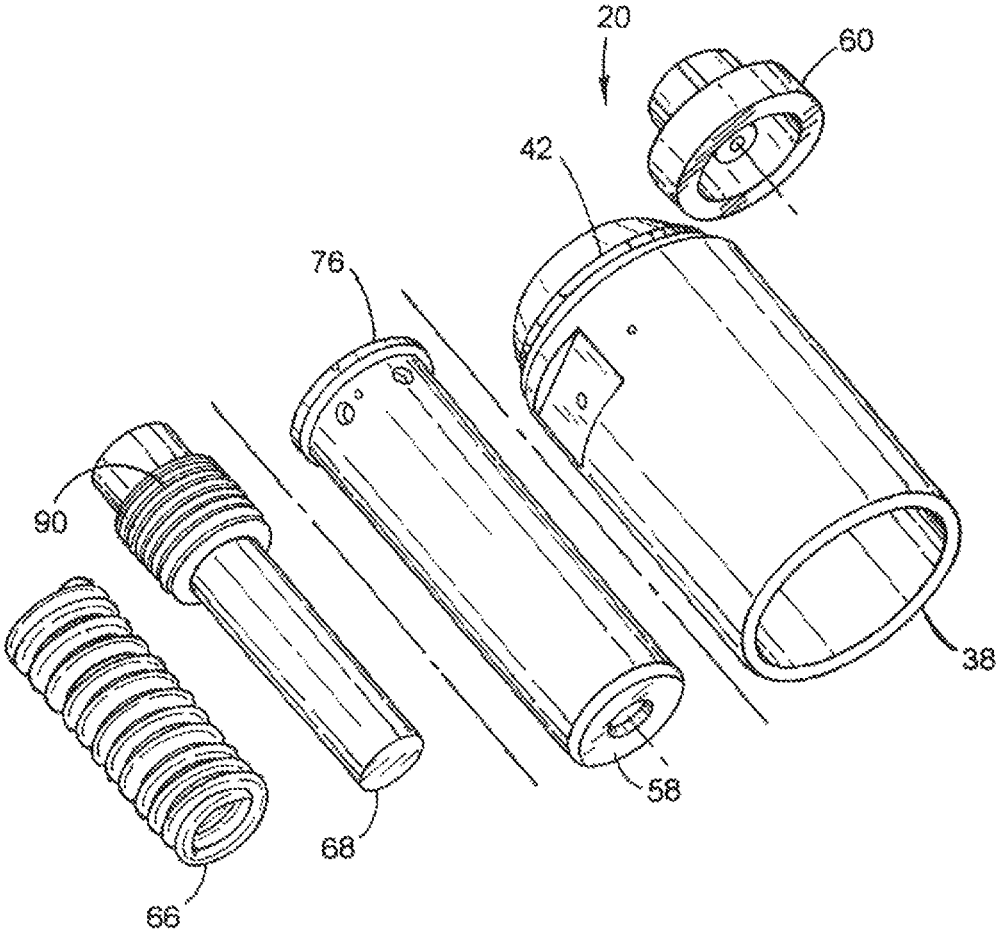
FIG. 10 is an exploded perspective view of the check valve of FIG. 8.
Figure 12:
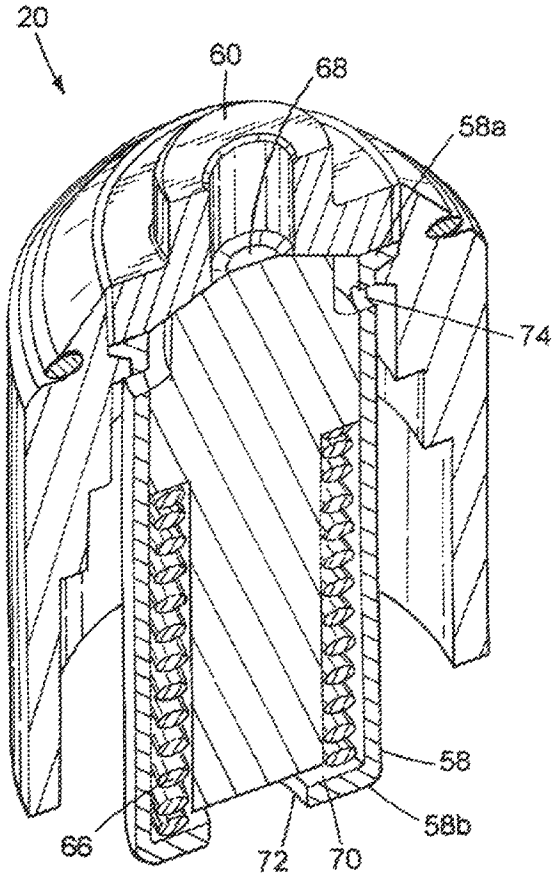
FIG. 12 is a top perspective cross-sectional view of the check valve of FIG. 8.
Figure 11:
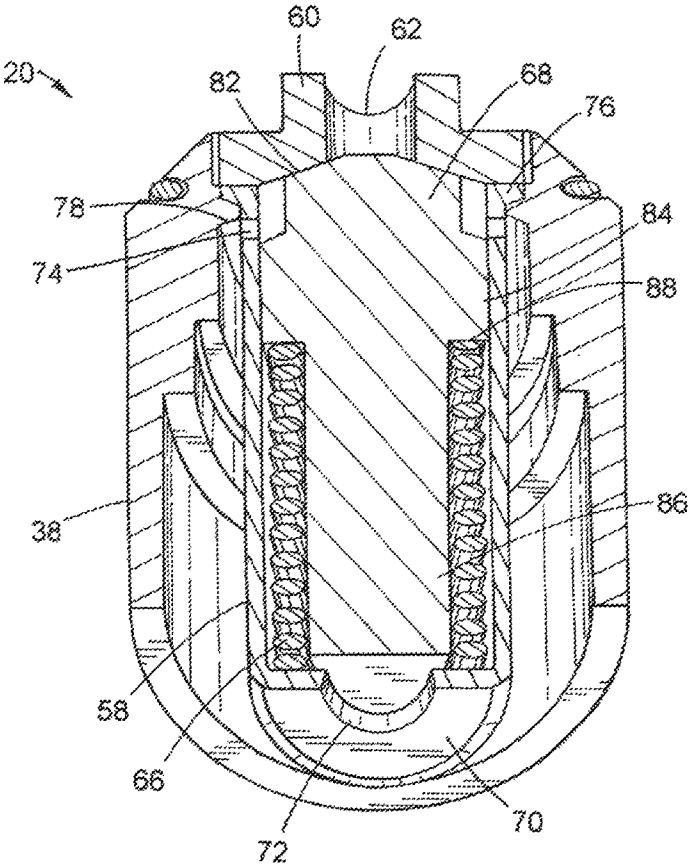
FIG. 11 is a bottom perspective cross-sectional view of the check valve of FIG. 8.

About a top end of the first check valve 34 is a relief valve seat 60 configured as shown in FIGS. 4, 10 and 11. The relief valve seat 60 can be fixedly attached to the check valve housing 38, for example, by threaded engagement. The relief valve seat 60 includes a central through hole 62 for allowing the passage of working fluid volumes therethrough in a manner as further discussed below. The through hole 62 forms a portion of passageway 64.

The second check valve 36 is mounted to the first check valve 34 for controlling a flow of working fluid through passageway 64 (FIG. 14) extending through the valve housing of the first check valve. As best shown in FIG. 4, the second check valve 36 is mounted within the first check valve and includes a second biasing member 66 that biases the second check valve.

Situated within the check valve housing 38 is the relief valve guide or valve guide 58 and a relief valve poppet 68. The relief valve guide 58 is sized and shaped to receive and house the relief valve poppet 68. The valve guide 58 extends preferably from an underside of the valve seat 60 and preferably past (i.e., below) a bottom end 38*b* of the check valve housing 38. The valve guide 58 (FIGS. 10-14) is generally configured as a tubular member having an open top end 58*a* and a bottom end 58*b* forming a bottom surface 70. The bottom surface 70 includes a through hole 72 for equalizing pressure within the check valve. The valve guide 58 also includes one or more, and preferably a plurality, of through holes 74 about its upper end. The foregoing relief valve guide 58 and relief valve poppet 68 provide an adjustable pressure relief valve that is integrated into the pressure control check valve assembly 20.

Positioned about a top end 58*a* of the valve guide 58 is an outwardly extending flange 76 for engaging the relief valve seat 60 and an inwardly extending flange 78 of the check valve housing 38. That is, the flange 76 is situated between the relief valve seat 60 and the flange 78 so as to be held in a fixed position therebetween within the check valve housing 38.

Figure 14:
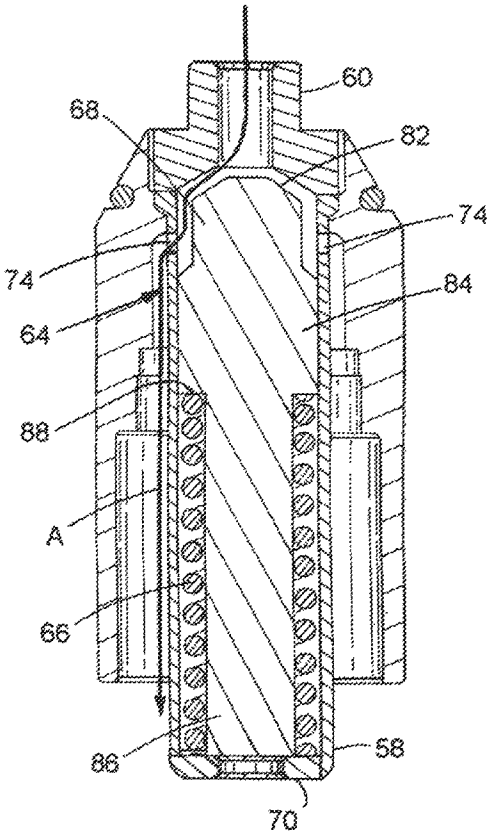
FIG. 14 is a cross-sectional elevation view of the check valve of FIG. 8 with a relief valve in an open position.

The relief valve poppet 68 is configured as best shown in FIGS. 4 and 10-14. The relief valve poppet 68 includes a tapered top end 82, an enlarged width end 84 about a upper region of the relief valve poppet, and a tail end 86. The tapered top end 82 is an engaging surface for engaging the valve housing of the first check valve. The enlarged width end 84 is spaced from the tapered top end a distance sufficient enough such that it does not block or cover the through holes 74 of the relief valve guide 58 when the relief valve poppet is moved between a closed position (FIG. 13) and an open position (FIG. 14). The transition between the enlarged width end 84 and the tail end 86 forms a flange 88 having a downwardly facing external surface. Preferably, the relief valve poppet 68 has a substantially cylindrical shape and the enlarged width end 84 is configured with a plurality of external grooves 90 (i.e., anti-lock grooves), see FIG. 10. The relief valve poppet 68 slidingly engages the valve guide.

Figure 13:
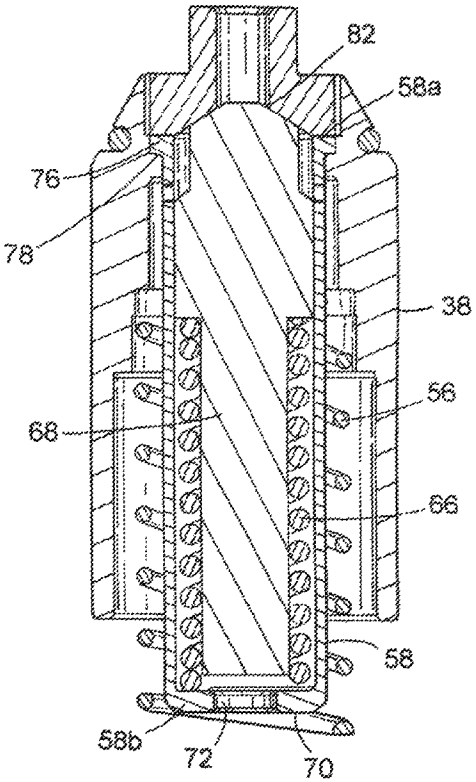
FIG. 13 is a cross-sectional elevation view of the check valve of FIG. 8 with a relief valve in a closed position.

Referring to FIGS. 13 and 14, the second biasing member or poppet biasing member 66 (e.g., a compression spring) is positioned between the flange 88 of the relief valve poppet 68 and the bottom surface 70 of the relieve valve guide for biasing the relief valve poppet to the closed position (FIG. 13). Thus, one end of the second biasing member 68 engages the bottom surface 70 and an opposite end engages the flange 88 for biasing the relief valve poppet towards the relief valve seat 60. That is, the second biasing member has a first end biasing against the valve guide and a second end opposite the first end biasing against the valve poppet.

The second biasing member 66 is configured to have a spring constant greater than the first biasing member or check valve biasing member 56. In other words, the second biasing member applies a force greater than the first biasing member. Preferably, the second biasing member 66 is situated to circumscribe the tail end 86 of the relief valve poppet 68. The second biasing member 66 can be any biasing member suitable for the intended purposes described above, such as a compression spring, leaf spring, an elastomer, and the like. Preferably, the second biasing member is a compression spring.

Referring back to FIG. 4, the first check valve 34 is shown in the open position. In operation, the first check valve 34 is movable between the open position and a closed position (see FIG. 15 of another embodiment). In the closed position, the chamfered top end 38*a* sealingly engages a chamfered internal wall 13 of the backhead 12 to seal off the flow of working fluid from entering the internals of the DHD hammer 10 from the supply inlet 18. Thus, in operation, the first check valve 34 moves between a first position (FIG. 15) and a second position (FIG. 4). In the first position, the first check valve engages the backhead to prevent the flow of working fluid from the backhead to an internal region of the DHD hammer. In the second position, the first check valve is spaced from the backhead allowing a first flow passageway 80 (represented by arrow B in FIG. 4) of working fluid from the backhead to the internal region of the hammer.

In other words, when the first check valve 34 is in an open position, the first flow passageway 80 allows for the flow of working fluid to travel from the supply inlet 18, between the backhead 12 and the first check valve 34, through the through holes 54 of the distributor and into the driver chamber 30. The first check valve 34 is moved from the closed position to the open position when a supply pressure of working fluid greater than a cracking pressure of the first check valve is reached.

However, when the DHD hammer 10 is exposed to wet operating conditions, the amount of air consumption within the internals of the DHD hammer 10 drops or reduces thereby creating a greater pressure differential between the pressure above the pressure control check valve assembly 20 or at a top end of the check valve and the pressure below the pressure control check valve assembly 20 or at a bottom end of the check valve. This is referred to as the differential pressure across the hammer. The overall pressure differential about the opposite ends of the pressure control check valve assembly 20 also builds up as a result of the increase in resistance to flow of working fluid volumes from water accumulating outside the DHD hammer 10.

In other words, taking Q as air flow rate, Ps as hammer inlet pressure, Pe as hammer exhaust pressure, dP as differential pressure across the hammer (Ps-Pe), and R as the pressure ratio (Ps/Pe), the air consumption rate of the DHD hammer Q/dP is generally a constant, but is reduced substantially as the pressure ratio R is reduced. For example, when "dusting" (i.e., drilling in which the hole is dry and no water is added to the compressed air supply) the pressure ratio R can be in the 15 to 20 range, but when "misting" (i.e., drilling with water injected into the compressed air supply) the pressure ratio R can reach as low as 4 to 5. Thus, the slope of the Q/dP ratio can be reduced by 40% with a drop in R. It is this change in slope of the Q/dP ratio where an elevated differential pressure on the DHD hammer can be created sufficient to activate the pressure control check valve.

When the resulting increase in pressure differential reaches a predetermined value, the relief valve poppet 68 is biased to the open position (FIG. 14) thereby providing an increased air flow area for working fluid volumes to flow through. That is, when the relief valve poppet 68 is moved to the open position, it provides a second flow passageway 64, as illustrated by arrow A on FIG. 14. The second flow passageway 64 works in combination with the first flow passageway 80 to provide a variable flow area for the passage of working fluid volumes from the supply inlet 18 to the DHD hammer's drive chamber 30. As a result, the present invention advantageously provides optimal matching of air consumption and pressure within the DHD hammer 10 to the capabilities of a power source (e.g., a compressor) to supply working fluid volumes thereto.

In sum, the present invention provides a pressure control check valve assembly 20 that provides a first open state for providing a first flow passageway and a second open state for providing first and second flow passageways. In other words, the DHD hammer is moved to the first open state at a first pressure differential and then moves to the second open state at a second pressure differential that is greater then the first pressure differential. For example, the first check valve can be configured to open at a pressure differential of about 5-10 psi, whereas the second check valve can be configured to open at a pressure differential of about 300-500 psi.

Figure 15:
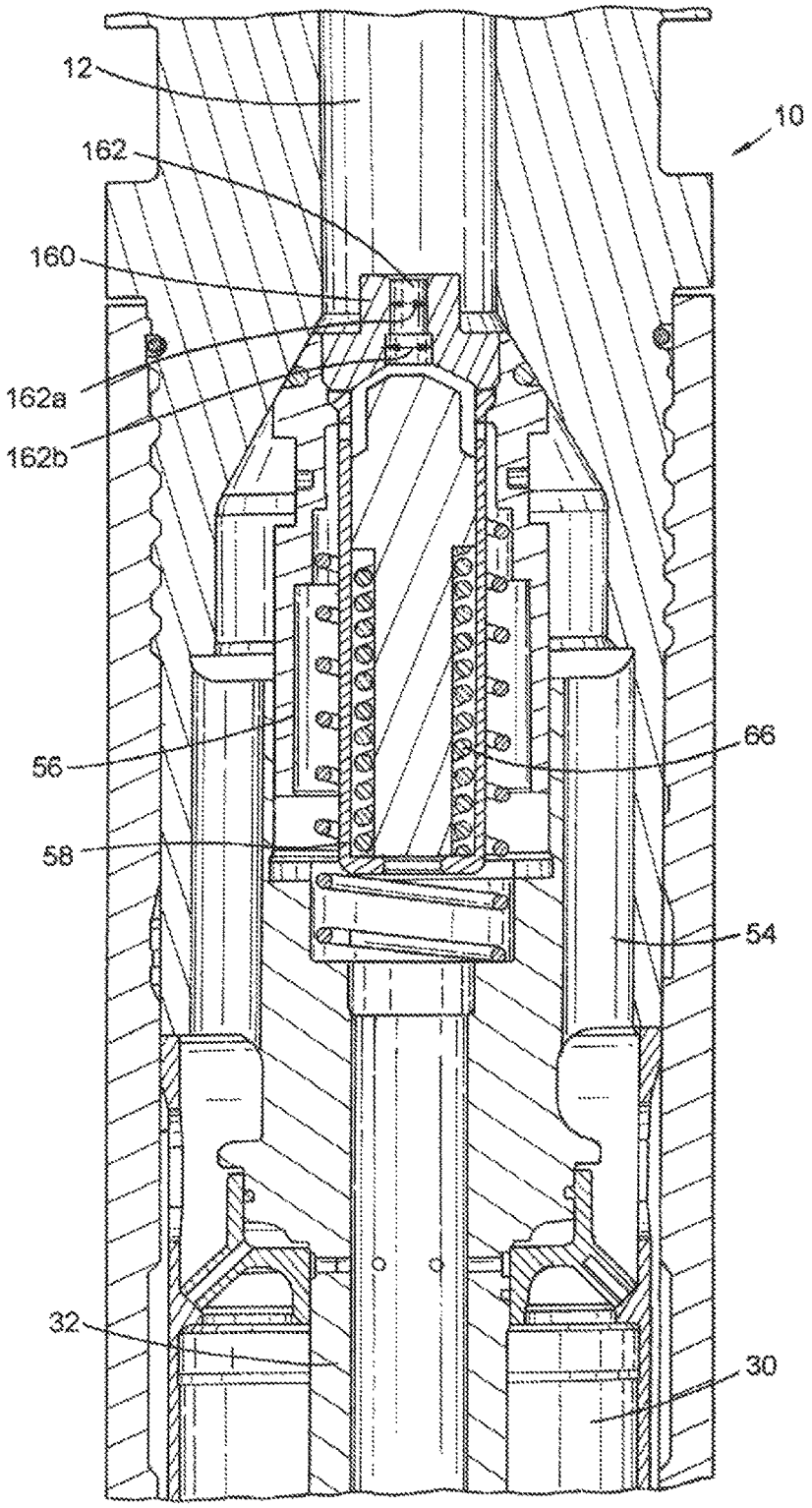
FIG. 15 is an enlarged partial cross-sectional elevation view of an upper portion of a down-the-hole drill hammer in accordance with another preferred embodiment of the present invention.

Alternatively expressed, the present invention includes a DHD hammer that includes a check valve 20 (referred to above as the pressure control check valve assembly) having a relief valve 36. The check valve 20 is mounted within the housing for controlling a flow of working fluid through the backhead 12. The check valve 20 includes the check valve housing 38 and relief valve seat 60 having a through hole 62 which is in communication with the housing interior. While the check valve housing 38 and relief valve seat 60 are shown as separate components, the check valve housing and relief valve seat can alternatively be formed as a unitary component. The check valve housing defines a passageway 64 therethrough for the passage of working fluid from the supply inlet 18 to the drive chamber 30. The check valve 20 also includes a biasing member 56 that applies a force to bias the check valve to a closed position, as shown in FIG. 15.

The relief valve 36 includes the relief valve poppet 68 which is mounted within a relief valve guide 58 as described above, and is mounted within the check valve housing. Specifically, the check valve 20 is mounted to the distributor 44. The relief valve controls the flow of working fluid through the check valve 20, in particular, the flow of working fluid through the through hole 62 of the relief valve seat 60. The relief valve poppet is normally biased to the closed position, as shown in FIG. 4, by the biasing member 66. The biasing member 66 exerts a greater force than the biasing member 56. As such, the relief valve 36 has a cracking pressure greater than a cracking pressure of the check valve 20. As further described above, the relief valve guide and relief valve poppet is housed within the check valve housing 38.

In operation, the check valve 20 moves between first, second, and third positions within the housing. In the third position the check valve engages the backhead to prevent the flow of working fluid from the backhead to an internal region of the hammer, such as the drive chamber and the relief valve engages the check valve to prevent the flow of working fluid through the check valve. In the first position the check valve is spaced from the backhead allowing a first flow passageway of working fluid from the backhead to the internal region of the hammer, such as the drive chamber. In the second position the relief valve is spaced from the check valve allowing for a second flow passageway of working fluid from the backhead to the internal region of the hammer through the check valve housing.

Thus, an exemplary operational description of the DHD hammer, by way of illustration and not by way of limitation, is as follows. The DHD hammer enters a drill hole with compressor operating parameters at 4,000 cfm (cubic feet per minute) and 350 psi (pound per square inch). The drill hole advances to 2,500 feet where water enters the hole and operating pressure of the DHD hammer begins to build to 400 psi. At 3,000 feet more water is encountered building operating pressure to 500 psi at which point the compressor begins to reduce output to 3,500 cfm to maintain 500 psi. The pressure control check valve opens at a predetermined cracking pressure to reduce the DHD hammer's operating pressure to 400 psi allowing the compressor to regain full output until the drill hole reaches a final depth.

Figure 16:
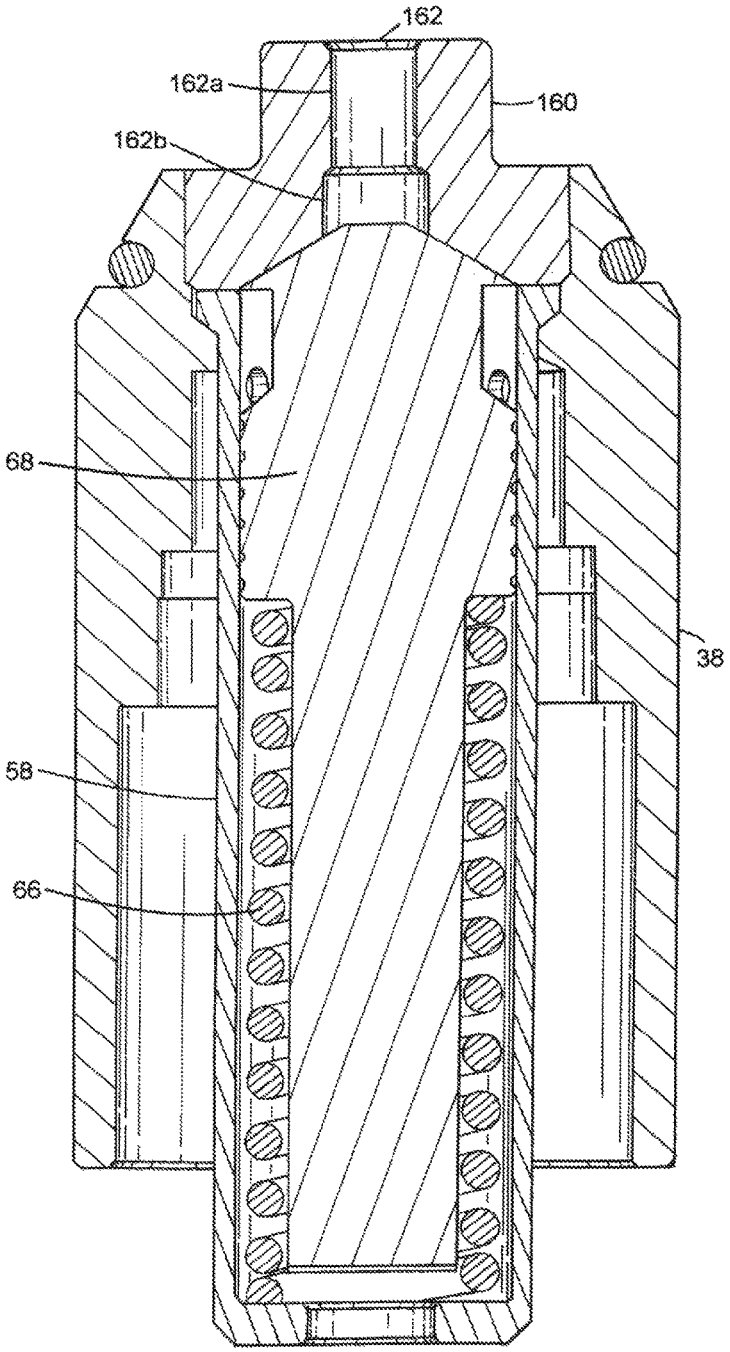
FIG. 16 is cross-sectional elevation view of a check valve assembly of the down-the-hole drill hammer of FIG. 15.

FIGS. 15 and 16 illustrate the DHD hammer 10 having an alternative configuration of a relief valve seat 160. In this configuration, the relief valve seat 160 has a through hole 162 having a variable diameter, such as a first diameter 162*a* and a second diameter 162*b* larger than the first diameter 162*a*.

Figure 17:
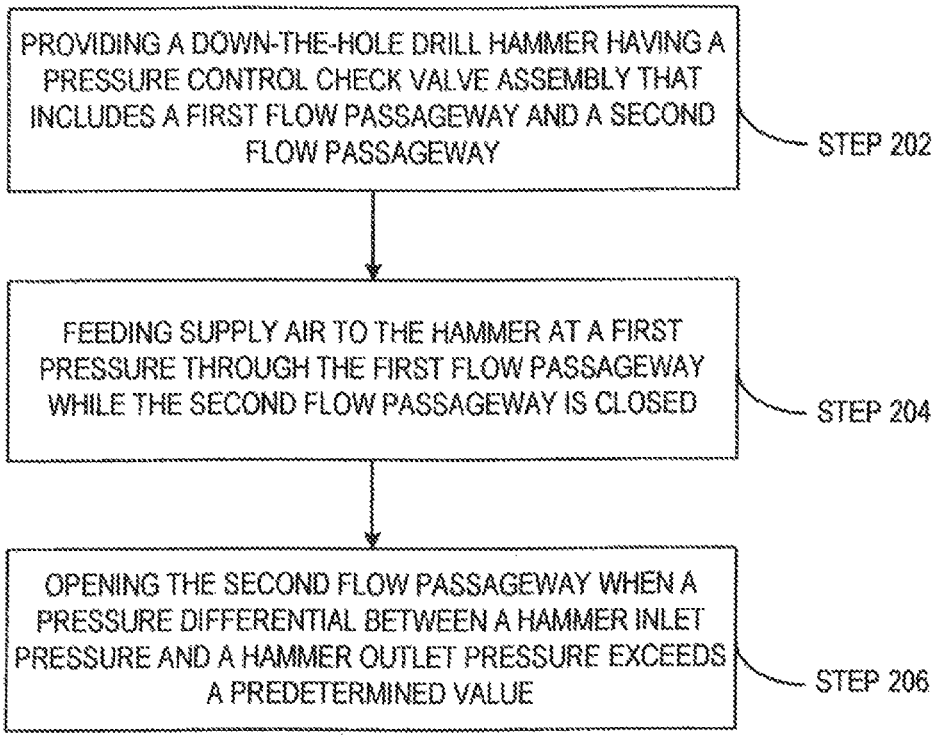
FIG. 17 is a flowchart of a method in accordance with a preferred embodiment of the present invention.

The embodiments of the present invention also provide a method of optimizing air consumption within the DHD hammer. The method includes providing a down-the-hole drill hammer having a pressure control check valve assembly 20 having a first flow passageway 80 and a second flow passageway 64 (Step 202) (FIG. 17). Then feeding supply air to the DHD hammer at a first pressure through the first flow passageway while the second flow passageway is closed (Step 204). The method also includes opening the second flow passageway 64 when a pressure differential between a DHD hammer inlet pressure and a DHD hammer outlet pressure exceeds a predetermined value (Step 206). Further details of the method of the present invention are described above in the operational descriptions of the DHD hammer.

It will be appreciated by those skilled in the art that changes could be made to the embodiments described above without departing from the broad inventive concept thereof. For example, additional components can be added to the DHD hammer or alternative shapes for the check valve assembly can be used. It is to be understood, therefore, that this invention is not limited to the particular embodiments disclosed, but it is intended to cover modifications within the spirit and scope of the present invention as defined by the appended claims.

I claim:

1. A down-the-hole drill hammer comprising:

a housing;

a backhead connected to the housing; and a check valve mounted within the housing for controlling a first flow passageway of working fluid through the backhead and in communication with a drive chamber, the check valve including a relief valve for controlling a second flow passageway of working fluid extending completely through a longitudinal length of the check valve and in communication with an exhaust gallery of the drill hammer.

2. The down-the-hole drill hammer of claim 1, wherein the relief valve has a cracking pressure greater than a cracking pressure of the check valve.

3. The down-the-hole drill hammer of claim 1, wherein the check valve moves between first, second, and third positions within the housing, wherein in the first position the check valve engages the backhead to prevent the flow of working fluid from the backhead to an internal region of the hammer, wherein in the second position the check valve is spaced from the backhead allowing the first flow passageway of working fluid from the backhead to the internal region of the hammer, and wherein in the third position the relief valve is spaced from the check valve allowing for the second flow passageway of working fluid from the backhead to the internal region of the hammer and the check valve is spaced from the backhead allowing for the first flow passageway of working fluid from the backhead to the internal region of the hammer.

4. The down-the-hole drill hammer of claim 1, further comprising a distributor mounted within the housing, and wherein the check valve is mounted to the distributor.

5. The down-the-hole drill hammer of claim 1, wherein the check valve includes a check valve housing having the second flow passageway therethrough, and wherein the relief valve is mounted within the check valve housing for controlling the flow of working fluid through the second flow passageway.

6. The down-the-hole drill hammer of claim 1, wherein the check valve further includes a valve guide and the relief valve is mounted within the valve guide.

7. The down-the-hole drill hammer of claim 6, wherein the valve guide includes an aperture extending radially through the valve guide.

8. The down-the-hole drill hammer of claim 1, wherein the check valve includes a biasing member to bias the check valve to a closed position, and wherein the relief valve includes a biasing member to bias the relief valve to a closed position.

9. The down-the-hole drill hammer of claim 1, wherein the valve seat is mounted within the valve housing.

10. The down-the-hole drill hammer of claim 1, wherein the check valve includes a check valve housing having the second flow passageway therethrough, and wherein the relief valve is mounted within the check valve housing for controlling the flow of working fluid through the second flow passageway.

11. A down-the-hole drill hammer comprising:

a pressure control check valve assembly mounted within a housing of the down-the-hole drill hammer, the pressure control check valve assembly including:

a first check valve for controlling a first flow passageway of working fluid through a backhead of the hammer and in communication with a drive chamber of the hammer, the first check valve including:

a valve housing, a valve seat mounted to the valve housing, a passageway extending through the valve seat and exiting the first check valve at a bottom end of the valve housing, and a first biasing member biasing the first check valve; and a second check valve mounted to the first check valve for controlling a second flow of working fluid extending completely through a longitudinal length of the passageway and in communication with an exhaust gallery of the hammer, the second check valve including:

a second biasing member biasing the second check valve.

12. The down-the-hole drill hammer of claim 11, wherein the first check valve further comprises a valve guide connected to the valve housing, and wherein the second check valve is mounted within the first check valve.

13. The down-the-hole drill hammer of claim 12, wherein the valve guide includes a through hole for fluid communication between an internal region and an external region of the valve guide.

14. The down-the-hole drill hammer of claim 12, wherein the second check valve further comprises a valve poppet, and wherein the second biasing member has a first end biasing against the valve guide and a second end opposite the first end biasing against the valve poppet.

15. The down-the-hole drill hammer of claim 14, wherein the valve poppet slidingly engages the valve guide.

16. The down-the-hole drill hammer of claim 11, wherein the first check valve includes an engaging surface for engaging the backhead of the hammer, and wherein the second check valve includes an engaging surface for engaging the valve housing.

17. The down-the-hole drill hammer of claim 11, wherein the second biasing member applies a force greater than the first biasing member.

18. The down-the-hole drill hammer of claim 11, the valve housing including a seal mounted adjacent to a proximal end of the valve housing.

19. A down-the-hole drill hammer comprising:

a housing;

a backhead having a supply inlet and connected to the housing;

a drive chamber within the housing;

a pressure control check valve assembly for controlling a first flow passageway and a second flow passageway;

wherein the first flow passageway is in fluid communication between the supply inlet and the drive chamber formed at a first differential pressure across the hammer; and wherein the second flow passageway is in fluid communication with the supply inlet at a second differential pressure across the hammer that is greater than the first differential pressure across the hammer and spaced from the first flow passageway along an entire length of the pressure control check valve assembly.

20. The down-the-hole drill hammer of claim 19, wherein the pressure control check valve assembly is moveable between a first position at the first differential pressure across the hammer, a second position at the second differential pressure across the hammer, and a third position for preventing fluid communication between the supply inlet and the drive chamber.

21. The down-the-hole drill hammer of claim 20, wherein the second flow passageway extends through the pressure control check valve.

22. The down-the-hole drill hammer of claim 19, further comprising a distributor mounted within the housing, the distributor including:

a lower body portion, a stem extending from the lower body portion, an upper body portion having a through hole, and a central through bore extending through the upper body portion, the lower body portion and the stem, wherein the first passageway is formed partially by the through hole and the second passageway is formed partially by the central through bore.

23. A method of optimizing air consumption within a down-the-hole drill hammer comprising:

providing a down-the-hole drill hammer having a pressure control check valve assembly that includes a first flow passageway and a second flow passageway;

feeding supply air to the hammer at a first pressure through the first flow passageway while the second flow passageway is closed; and opening both the first flow passageway and the second flow passageway when a pressure differential between a hammer inlet pressure and a hammer outlet pressure exceeds a predetermined value.

24. A down-the-hole drill hammer comprising:

a housing;

a backhead having a supply inlet and connected to the housing;

a drive chamber within the housing;

a first flow passageway in fluid communication between the supply inlet and the drive chamber formed at a first differential pressure across the hammer, wherein at the first pressure differential a check valve provides a first open state providing the first flow passageway; and a second flow passageway in fluid communication with the supply inlet at a second differential pressure across the hammer that is greater than the first differential pressure across the hammer, wherein at the second pressure differential the check valve provides a second open state providing the first and second flow passageways.

25. A down-the-hole drill hammer comprising:

a housing;

a backhead connected to the housing; and a check valve mounted within the housing for controlling a first flow passageway of working fluid through the backhead and around the entire check valve, the check valve including a relief valve for controlling a second flow passageway of working fluid through the check valve and coaxial with the first flow passageway, wherein the check valve moves between first, second, and third positions within the housing, wherein in the first position the check valve engages the backhead to prevent the flow of working fluid from the backhead to an internal region of the hammer, wherein in the second position the check valve is spaced from the backhead allowing the first flow passageway of working fluid from the backhead to the internal region of the hammer, and wherein in the third position the relief valve is spaced from the check valve allowing for the second flow passageway of working fluid from the backhead to the internal region of the hammer and the check valve is spaced from the backhead allowing for the first flow passageway of working fluid from the backhead to the internal region of the hammer.

26. The down-the-hole drill hammer of claim 25, wherein the relief valve has a cracking pressure greater than a cracking pressure of the check valve.

* * * * *